United States Patent [19]

Baigas, Jr.

[11] Patent Number: 4,556,521

[45] Date of Patent: Dec. 3, 1985

[54] EVAPORATIVE COOLER WITH HIGH LOFT COOLER PAD

[75] Inventor: Joseph F. Baigas, Jr., Waco, Tex.

[73] Assignee: Hobbs Bonded Fibers, Groesbeck, Tex.

[21] Appl. No.: 499,359

[22] Filed: May 31, 1983

[51] Int. Cl.[4] ..... B01F 3/04

[52] U.S. Cl. ..... 261/94; 62/314; 261/106; 261/DIG. 3; 261/DIG. 72; 428/159

[58] Field of Search ..... 261/94, 106, DIG. 3, 261/DIG. 72; 428/159, 286, 287; 62/314

[56] References Cited

U.S. PATENT DOCUMENTS

| | | | |
|---|---|---|---|
| 2,610,893 | 9/1952 | Collins et al. | 261/DIG. 72 |
| 2,879,197 | 3/1959 | Muskat et al. | 428/159 X |
| 3,171,820 | 3/1965 | Volz | 261/94 X |
| 3,220,707 | 11/1965 | Weatherston et al. | 261/22 |
| 3,314,080 | 4/1967 | Shilling, Jr. | 4/353 |
| 3,395,900 | 8/1968 | Meek | 261/29 |
| 3,410,057 | 11/1968 | Lerner | 261/94 X |
| 3,612,033 | 10/1971 | Chilcoat | 126/113 |
| 3,748,217 | 7/1973 | May et al. | 428/286 |
| 3,821,065 | 6/1974 | Copeland et al. | 156/72 X |
| 3,839,138 | 10/1974 | Kyle et al. | 428/287 |
| 3,870,540 | 3/1975 | Norgard | 428/159 X |
| 4,045,523 | 8/1977 | Goettl | 261/97 |
| 4,231,975 | 11/1980 | Peltier | 261/99 |
| 4,338,266 | 7/1982 | Flower | 261/94 |
| 4,362,774 | 12/1982 | Brandon, Jr. et al. | 428/159 |
| 4,379,712 | 4/1983 | Sperr, Jr. et al. | 261/DIG. 3 |
| 4,454,187 | 6/1984 | Flowers et al. | 428/159 |

*Primary Examiner*—Richard L. Chiesa

*Attorney, Agent, or Firm*—Bell, Seltzer, Park & Gibson

[57] ABSTRACT

An evaporative cooler in which a cooler pad includes a high loft body of synthetic fibers coated with a hydrophilic foam. The open nature of the pad allows air to flow freely through the pad, while the foam coating the fibers serves to wick water contacting the pad throughout the pad thus optimizing the cooling efficiency of the pad.

13 Claims, 4 Drawing Figures

EVAPORATIVE COOLER WITH HIGH LOFT COOLER PAD

FIELD AND BACKGROUND OF THE INVENTION

This invention relates generally to a device for cooling low humidity air through liquid evaporation, and more particularly to high loft pads for use in such a device and the method of manufacturing such pads.

Application of the principle of humidification or liquid evaporation to accomplish cooling of air has been utilized frequently in the past. Through it, air at uncomfortably high temperatures, usually in excess of 90° F., and with a relatively low relative humidity can be cooled to a comfortable temperature without the need of condenser type air conditioning apparatus with its attendant high energy requirements. Accordingly, this principle has been widely used for air cooling in those arid areas of the world which typically have high temperatures and low humidities.

An evaporative cooling system typically consists of a high volume blower or fan driven by an electric motor, a water distribution system, and cooler pads which are contacted by air and water, the pads providing the surface area whereon the evaporation of the water occurs. In the past these pads have typically utilized aspen wood excelsior as the material for adsorbing and absorbing the water and serving as the media on which evaporation takes place. While this material, at least when new, has proven to be a relatively good material on which to carry out the water evaporation process, it nonetheless has exhibited a number of undesirable characteristics.

Firstly, these wood shavings, by being organic and having a relatively high sugar content, have proven to be effective breeding grounds for various types of bacteria and molds carried by the air. This has resulted in coolers containing such pads soon giving off very objectionable swamp-like odors, and for this reason, coolers employing aspen excelsior have often been called "Swamp coolers." Indeed, as this bacterial action continues on the shavings, the shavings are literally consumed and rendered worthless.

Secondly, as the shavings are continuously contacted by air and water, both containing various chemical and physical contaminants, the light weight shavings soon begin to load up with these contaminants and lose their ability to facilitate water evaporation. This contaminant loading also causes the shavings to sag and shift in their pad frames so as not to be uniformly spaced as desired and so as to destroy their desired air circulation characteristics.

Because of these deleterious effects caused by sustained use, pads containing aspen shavings must be frequently replaced. This is particularly undesirable since such pads are relatively expensive.

To overcome some of these shortcomings, it has been suggested to substitute porous polyurethane material for wood shavings in certain evaporative cooler pads. Such plastic material does eliminate the mold build-up problem to a degree (not being an organic vegetable material like wood), but the plastic still presents problems of its own in operation, in that the moving air does not readily pass through the polyurethane and the water contacting the polyurethane pad is usually not uniformly distributed therein. Also, foam materials of this type have poor resistance to alkalinity and chlorine and fluorine, all of which are particularly present in the waters of the arid areas in which evaporative coolers are most typically used. These deficiencies substantially detract from the operating efficiency and the usefulness of such pads.

SUMMARY OF THE INVENTION

The foregoing shortcomings and deficiencies are met by the present invention which relates generally to a device for cooling low humidity air through liquid evaporation. This device is characterized by having an evaporative cooler pad with a high loft body of synthetic fibers coated with a hydrophilic foam. Such a pad with its lofty construction and foam coating, which bridges and spans random portions of interstices and passageways throughout the pad, permits free air flow therethrough, and also substantially increases the available surface area for contact of water with the air flowing through the pad to optimize the relative cooling efficiency.

As well as imparting water retaining and wicking properties to the synthetic fiber body, the foam also serves to bond the fibers together. Moreover, if further stability is desired, a prebonding agent may be applied to the synthetic fiber body prior to application of the foam.

It is another object of the invention to provide an evaporative cooler pad which is reusable and which has a relatively long service life.

Further and more specific objects and advantages of the invention will become apparent as the description progresses.

BRIEF DESCRIPTION OF THE DRAWINGS

Some of the objects and features of the invention having been stated, others will become more apparent as the description proceeds, when taken in connection with the accompanying drawings in which.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
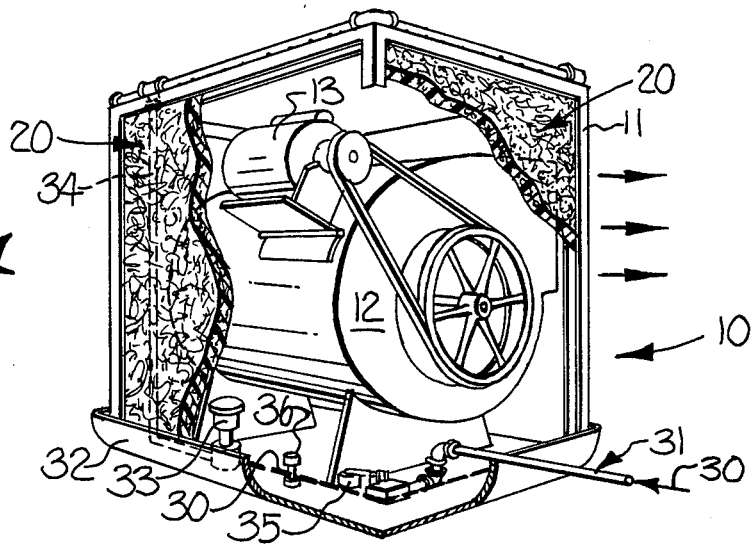
FIG. 1 is a perspective view in environmental setting of the evaporative cooler of the invention.

Referring now to FIG. 1, an evaporative cooler device 10 in accordance with the invention is shown along with its basic components. These basic components, other than the cooler pad, are for the most part conventional and include an enclosure 11 which contains a relatively high volume, low speed fan or blower 12 driven by an electric motor 13.

The enclosure 11 is generally exposed to the air to be treated. Although not shown, three of the four side walls of the enclosure 11 are typically provided with openings such as louvers or perforations to permit air to flow into the enclosure in response to the action of the blower 12. Air to be cooled passes from the exterior to the interior of the enclosure 11. In so doing it passes through the evaporative cooler pads 20 which are installed on the side walls provided with openings. These cooler pads 20 may be of whatever size is desired so that they may be installed on a wall in plural number or large enough for one pad to cover an entire enclosure wall. Cooling of the air passing through the cooler device 10 is accomplished by feeding water 30 through the cooler pads 20 while at the same time operating the blower 12 to pull air through the cooler pads 20. Thus, while the air is passing through the pads 20, liquid water 30 is being vaporized therein. This results in the temperature of the air being lowered, and its relative humidity being raised. The cooled air is then moved by the blower 12 into the area being cooled (not shown).

The water 30 is supplied to the cooler pads 20 by a water distribution system 31. The water distribution system 31 desirably comprises a water tank 32 in the bottom of enclosure 11, a water recirculating pump 33 mounted in the water tank 32, a water line 34 passing from the pump 33 to the upper portion of the enclosure 11 leading to water outlets (not shown). In operation the pump 33 drives the water 30 from the outlets at a predetermined rate. As the water 30 passes through the pads 20 a portion of it is vaporized and is carried off with the air passing through the cooler 10. That water which is not vaporized and carried off with the air and which does not remain in the pads 20 drips down into the tank 32. The level of water 30 in the tank 32 is maintained at a predetermined level. If it drops below that level, a float valve 35 is actuated to introduce additional water 30 to the water tank 32 from an external source (not shown). If the level of water 30 in the tank 32 rises above the predetermined level, it is carried off by a water overflow pipe and drain 36.

Figure 3:
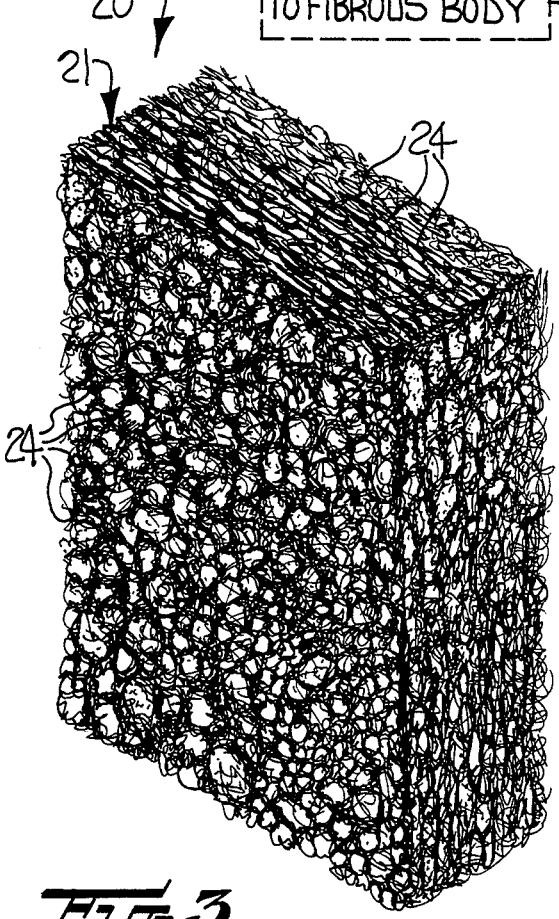
FIG. 3 is an enlarged partial sectional view of the evaporative cooler pad of the invention.
Figure 4:
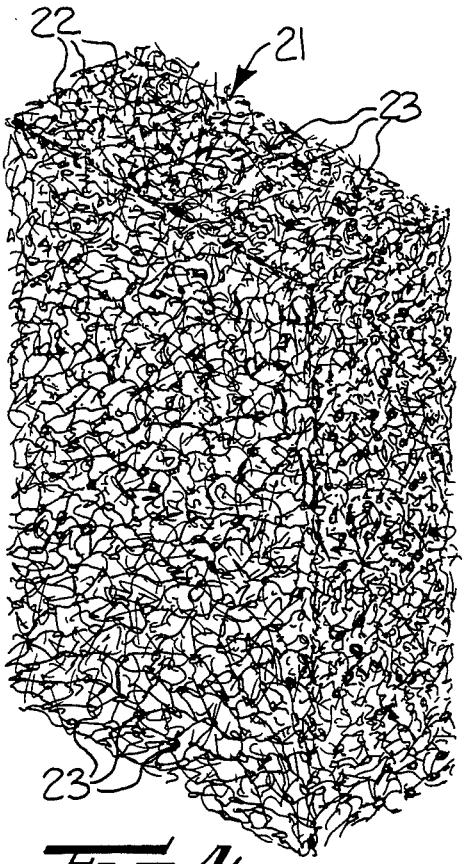
FIG. 4 is an enlarged partial sectional view of the fiber body of the cooler prior to the application of the hydrophilic foam, wherein the filaments have been prebonded.

Referring now more particularly to the pad 20 and to FIGS. 3 and 4, the pad 20 is comprised of a high loft body 21 of randomly oriented synthetic fibers 22. As shown in FIG. 3 and perhaps even better shown in FIG. 4, these fibers 22 are separated from one another along the greater part of their respective lengths, forming interconnecting interstices and passageways throughout the body 21 such that air directed toward the pad 20 may flow generally freely therethrough in all directions.

The fibers 22 are desirably polyester in deniers of about 25 to about 250, lengths of about 1 inch to about 6 inches, and crimped.

Preferably a prebonding agent 23 is applied to the body 21 in order to stabilize the body 21 for further treatment and use. The agent 23 is applied in such volume and manner such that it coats only portions of the fibers 22 and their interconnecting interstices. This is done to maintain the high loft nature of the body 21 and free flow air characteristics.

The prebonding agent 23 may be a polymeric acrylic emulsion such as products designated Rhoplex HA-16 or TR-407, available from Rohm and Haas Company. The Rhoplex HA-16 product is a nonionic, self-crosslinking acrylic polymer emulsion. The Rhoplex TR-407 product is an anionic, self-crosslinking acrylic emulsion. They both adhere well to synthetic fibers and resist washing off even under continued contact by water.

As shown more specifically in FIG. 3, the pad 20 also comprises a hydrophilic preformed foam 24 which substantially coats and bonds the fibers 22 of the body 21 to one another, and which also bridges and spans random portions of the interstices and passageways therethrough. The preformed foam 24 thus creates substantially increased surface area in the body 21 so that the available surface area of the pad 20 for contact by water is accordingly increased. This preformed foam also desirably has a minute cellular structure throughout including its surface which produces a capillary type effect when contacted by water. Thus when the pad 20 of the invention is contacted by water in use, the foam 24 serves to wick the water along the foam coated areas of the pad 20 to substantially increase the surface area of the pad 20 contacted by the water when the air is flowing through the pad 20. This optimizes the relative cooling efficiency of the pad 20 through maximum utilization of the pad 20 for water evaporation. Additionally, in order to obtain optimum cooling efficiency, the foam 24 is applied in such volume and manner such that not all but only random portions of the interstices and passageways formed by the intersecting fibers 22 are spanned by the foam 24. This is desired to allow the pad 20 to maintain its free air flow characteristics.

The foam 24 generally comprises a vinyl acetate homopolymer emulsion, a polymeric acrylic emulsion, a foam stabilizer and water. More specifically, it has been found that a suitable foam may be composed of from about 50 to about 150 parts by volume of a vinyl acetate homopolymer emulsion, of from about 150 to about 50 parts by volume of a polymeric acrylic emulsion, of from about 5 to about 25 parts by volume of a foam stabilizer, of from about 0.5 to about 5 parts by volume of a rewettable wetting and dispersing agent, and from about 25 to about 200 parts by volume of water. As an optimum, the foam 24 is comprised of about 100 parts by volume of a vinyl acetate homopolymer, about 75 parts by volume of a polymeric acrylic emulsion, about 10 parts by volume of a foam stabilizer, about 3 parts by volume of a rewettable wetting and dispersing agent and about 100 parts by volume of water.

In the above formulations it has been determined that the vinyl acetate homopolymer may be a product designated UCAR Latex 130, available from Union Carbide Corporation. UCAR Latex 130 is a large particle size, relatively high molecular weight polyvinyl acetate homopolymer emulsion. The latex is stabilized with a hydroxylcellulose protective colloid giving it excellent mechanical and electrolytic stability. The polymeric acrylic emulsion may be a product designated Experimental Emulsion E-751, available from Rohm and Haas Company. Experimental Emulsion E-751 is a soft hydrophilic acrylic polymer emulsion which provides excellent wet strength. The foam stabilizer may be a product designated Ammonium Stearate 33%, available from Diamond Shamrock Corporation. Ammonium Stearate 33% is an effective foam stabilizer that functions as a primary or secondary foaming agent to develop relatively uniform cell structure. It disperses easily into water and is compatible for use with acrylic, vinyl chloride or nitrile latex emulsions. The rewettable wetting and dispersing agent may be a product designated Decerisol OT, available from American Cyanamid Company.

Since the foam 24 serves to bond the fibers 22 of the body 21, if desired the prebonding agent 23 may be omitted in formation of the pad 20. However, inclusion of prebonding agent 23 yields a body 21 with increased stability and durability. Where the prebonding agent is included, it underlies the hydrophilic foam 24 at those portions of the pad body 21 coated both by the prebonding agent 23 and the foam 24.

Insofar as the composition of the foam 24 is concerned, it has also been determined that latex emulsions other than vinyl acetate homopolymers may be used as the primary emulsifying ingredient of the foam. Other suitable ingredients include latex emulsions of styrene butadiene, nitrile and polyvinyl resins generally. When using these latter ingredients, however, it may be desirous to add a soap such as sodium laurel sulfate to aid foaming. Finally, if desired, it is possible to add inert fillers to some degree to the foam 24 to reduce the cost of same without significantly adversely affecting performance. Such inert fillers as clay or diatomaceous earth may be added to the degree that the foam composition can retain these particles and still carry out its intended function.

Figure 2:
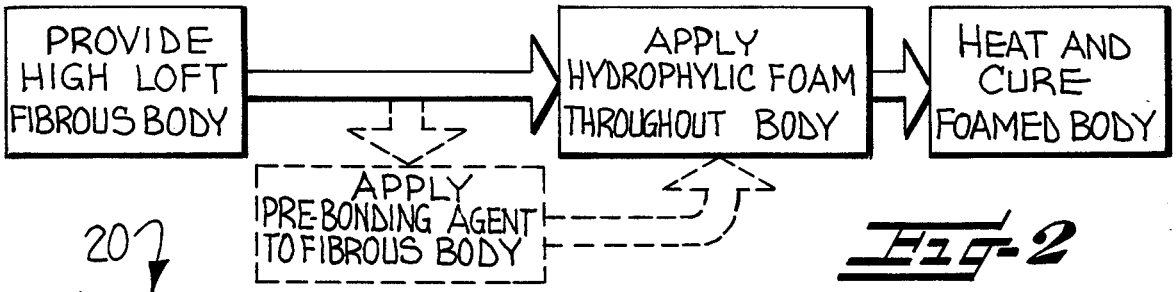
FIG. 2 is a schematic diagram of the method of manufacturing the evaporative cooler pad of the invention.

With regard to the manufacture of the pad 20, the preferred basic steps are shown in FIG. 2 of the drawings. The first step is to provide a high loft body of intersecting synthetic fibers 22. The next step preferably is applying a latex water emulsion prebonding agent 23 to the body of fibers 22 in such volumes as to coat only minor portions of such fibers and then heating and curing the prebonding agent 23 and stabilizing the body of fibers. This step may employ air lay carding or garnetting with the prebonding agent 23 being sprayed on the fibers 22. As already noted above this prebonding may be omitted altogether.

After this, the hydrophilic foam 24 is applied to the desirably prebonded body of fibers 22, and the foamed body is passed through a set of nip rolls to distribute the foam 24 therein. The foam 24 is supplied in such volume as to coat the fibers of the body 21 and also to bridge and span random portions thereof. The foamed body is then heated and cured to form the desired bonded cooler pad material which may be retained in rolls or cut in slabs of desired size.

In one particular process of manufacture 100 denier polyester staple fibers are provided with a cut length of about 3". These are garnetted to form a web of somewhat more than about 2" in thickness. This requires about 14 ounces per square yard of fiber. A latex water emulsion prebonding agent is then applied, heated, cured and dried to yield a prebonded body of about 20 ounces per square yard. This web of body is then foamed with foam being added at a weight of approximately 8 to 10 ounces per square yard to yield a pad product with a weight of about 28 to 30 ounces per square yard and a thickness of about 2".

Application tests in evaporative cooler installations of the type shown in FIG. 1 have shown the pad of the invention to have a low pressure drop in air flow of a magnitude equal to or less than that of pads filled with fresh aspen shavings. Such tests utilizing a pad 20 about 1" thick have yielded an evaporative efficiency of 80% of available wet bulb temperature cooling with entrance air at 105° F. and 12% relative humidity. These results were obtained even with the water outlets being spaced some 2" to 4" apart.

There is thus provided by this invention an evaporative cooler pad 20 which yields a relatively high cooling efficiency while being simple to construct and inexpensive. This cooler pad 20 is also reusable in that it can be readily cleaned, if contaminated by water and air impurities, and has a relatively long service life. Finally, this pad does not promote mold and decay and thus does not add unpleasant odors to the air being cooled by the cooler; furthermore, the constituents of the pad 20 are nontoxic and noninjurious to life so that the pad may be safely used to cool air in dwellings.

In the drawings and specification, there has been set forth a preferred embodiment of the invention, and although specific terms are employed, they are used in a generic and descriptive sense only and not for purposes of limitation.

That which is claimed is:

1. An evaporative cooler comprising an enclosure, an evaporative cooler pad positioned within said enclosure, means for feeding water to the pad for flow through the pad, and a blower for moving air through the pad, said evaporative cooler pad comprising a high loft body of randomly oriented synthetic fibers, said fibers being separated from one another along the greater part of their respective lengths and forming interconnecting interstices and passageways throughout the body such that air directed toward the pad may flow generally freely therethrough in all directions, and said pad also comprising a hydrophilic preformed foam which substantially coats and bonds the synthetic fibers of the body and which also bridges and spans random portions of the interstices and passageways therethrough to substantially increase the available surface area of the pad for contact of the water with the air flowing therethrough, said preformed foam and its surface having a minute cellular structure serving as means for producing a capillary type effect when contacted by water whereby the pad upon being contacted by water wicks the water along its foam area to thereby optimize the relative cooling efficiency of the pad.

2. The evaporative cooler of claim 1 wherein said pad additionally comprises a prebonding agent which coats portions of the synthetic fibers of the pad body, said prebonding agent stabilizing the pad body and underlying the hydrophilic foam at those portions of the pad body coated by the prebonding agent and the hydrophilic foam.

3. The evaporative cooler of claim 2 wherein the prebonding agent of the cooler pad is a polymeric acrylic emulsion and wherein the hydrophilic foam of the cooler pad comprises a vinyl acetate homopolymer emulsion, a polymeric acrylic emulsion, a foam stabilizer and water.

4. The evaporative cooler of claim 2 wherein the hydrophilic foam of the cooler pad has a primary emulsifying ingredient selected from the group consisting of a vinyl acetate homopolymer, a styrene butadiene polymer, a nitrile polymer, and a polyvinyl resin.

5. An evaporative cooler comprising an enclosure, an evaporative cooler pad positioned within said enclosure, means for feeding water to the pad for flow through the pad, and a blower for moving air through the pad, said evaporative cooler pad comprising a high loft body of randomly oriented synthetic fibers, said fibers being separated from one another along the greater part of their respective lengths and forming interconnecting interstices and passageways through the body such that air directed toward the pad may flow generally freely therethrough in all directions, the body being stabilized with the prebonding agent which coats portions of the synthetic fibers of the body, said pad also comprising a preformed hydrophilic foam comprised of a vinyl acetate homopolymer emulsion, a polymeric acrylic emulsion, a foam stabilizer and water, which substantially coats and bonds the synthetic fibers of the body and which also bridges and spans random portions of the interstices and passageways therethrough to substantially increase the available surface area of the pad for contact of the water with the air flowing therethrough, said preformed foam and its surface having a minute cellular structure serving as means for producing a capillary type effect when contacted by water whereby the pad upon being contacted by water wicks the water along its foam areas to thereby optimize the relative cooling efficiency of the pad.

6. An evaporative cooler pad comprising a high loft body of randomly oriented synthetic fibers, said fibers being separated from one another along the greater part of their respective lengths, forming interconnecting interstices and passageways throughout the body such that air directed toward the pad may flow generally freely therethrough in all directions, said pad also comprising a preformed hydrophilic foam which substantially coats and bonds the synthetic fibers of the body and which also bridges and spans random portions of the interstices and passageways therethrough to substantially increase the available surface area of the pad for contact by water with air flowing therethrough, said preformed foam and its surface having a minute cellular structure serving as means for producing a capillary type effect when contacted by water whereby the pad upon being contacted by water wicks the water along its foam areas to thereby optimize the relative cooling efficiency of the pad.

7. The cooler pad of claim 6 which additionally comprises a prebonding agent which coats portions of the synthetic fibers of the body, said prebonding agent stabilizing the body and underlying the hydrophilic foam at those portions of the body coated by the prebonding agent and the hydrophilic foam.

8. The cooler pad of claim 7 wherein the prebonding agent is a polymeric acrylic emulsion and wherein the hydrophilic foam comprises a vinyl acetate homopolymer emulsion, a polymeric acrylic emulsion, a foam stabilizer and water.

9. The cooler pad of claim 7 wherein the hydrophilic foam has a primary emulsifying ingredient selected from the group consisting of a vinyl acetate homopolymer, a styrene butadiene polymer, a nitrile polymer, and a polyvinyl resin.

10. An evaporative cooler pad comprising a high loft body of randomly oriented synthetic fibers, said fibers being separated from one another along the greater part of their respective lengths and forming interconnecting interstices and passageways throughout the body such that air directed toward the pad may flow generally freely therethrough in all directions, the body being stabilized with a prebonding agent which coats portions of the synthetic fibers of the body, said pad also comprising a hydrophilic preformed foam comprised of a vinyl acetate homopolymer emulsion, a polymeric acrylic emulsion, a foam stabilizer and water, which substantially coats and bonds the synthetic fibers of the body and which also bridges and spans random portions of the interstices and passageways therethrough to substantially increase the available surface area of the pad for contact by water with air flowing therethrough, said preformed foam and its surface having a minute cellular structure serving as a means for producing a capillary type effect when contacted by water whereby the pad upon being contacted by water wicks the water along its foam areas to thereby optimize the relative cooling efficiency of the pad.

11. The cooler pad of claim 10 wherein the prebonding agent is a self-crosslinking acrylic polymer.

12. The cooler pad of claim 10 wherein the hydrophilic foam comprises, by volume, from about 50 to 150 parts acetate homopolymer emulsion, from about 150 to about 50 parts polymeric acrylic emulsion, from about 5 to about 25 parts foam stabilizer, from about 0.5 to about 5 parts rewettable wetting and dispersing agent and from about 25 to about 200 parts water.

13. The cooler pad of claim 11 wherein the hydrophilic foam comprises, by volume, about 100 parts acetate homopolymer emulsion, about 75 parts polymeric acrylic emulsion, about 10 parts foam stabilizer, about 3 parts rewettable wetting and dispersing agent and about 100 parts water.

* * * * *